United States Patent [19]

Tromp

[11] 4,264,992

[45] May 5, 1981

[54] PAPER SHEET CARTRIDGE

[76] Inventor: Gerardus M. Tromp, Van Alkemadelaan 1132, The Hague, Netherlands

[21] Appl. No.: 88,383

[22] Filed: Oct. 25, 1979

[51] Int. Cl.[3] ..... A47K 13/14

[52] U.S. Cl. ..... 4/244; 4/242; 221/46

[58] Field of Search ..... 4/242, 243, 244, 245–247; 221/46

[56] References Cited

U.S. PATENT DOCUMENTS

| | | | |
|---|---|---|---|
| 1,744,300 | 1/1930 | Dewaide | 4/243 |
| 2,025,941 | 12/1935 | Dunnell | 4/243 |
| 2,153,279 | 4/1939 | Shelley | 221/46 X |
| 2,166,996 | 7/1939 | Lemmon et al. | 4/244 X |
| 2,299,940 | 10/1942 | Thomasma | 221/46 X |
| 2,537,741 | 1/1951 | Clark | 221/46 |
| 3,028,047 | 4/1962 | Tuft | 221/46 X |
| 3,666,140 | 5/1972 | Brafka et al. | 221/46 |

*Primary Examiner*—Henry K. Artis

*Attorney, Agent, or Firm*—Finnegan, Henderson, Farabow, Garrett & Dunner

[57] ABSTRACT

A paper sheet cartridge from which shaped paper sheets are dispensed and positioned on a toilet seat including a flat container having an open end and a partition, a stack of sheets having one end extending through the container open end and the other end folded behind the partition, and a member in the container penetrating the sheets to hold them in the container but allowing the sheets to be withdrawn one-at-a-time from the container.

5 Claims, 8 Drawing Figures

FIG. 7
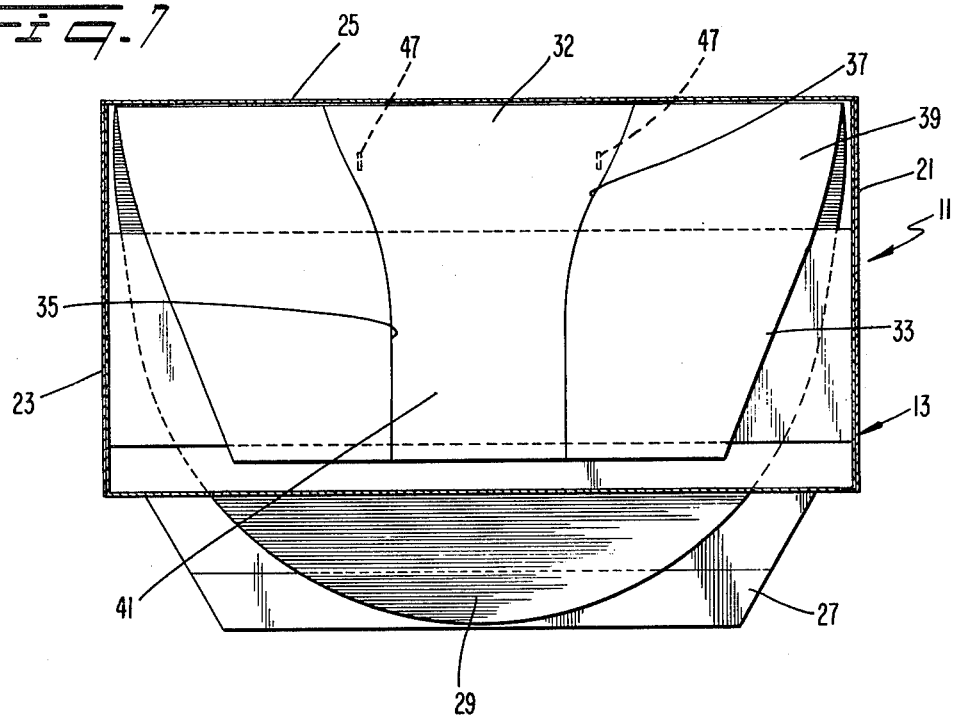
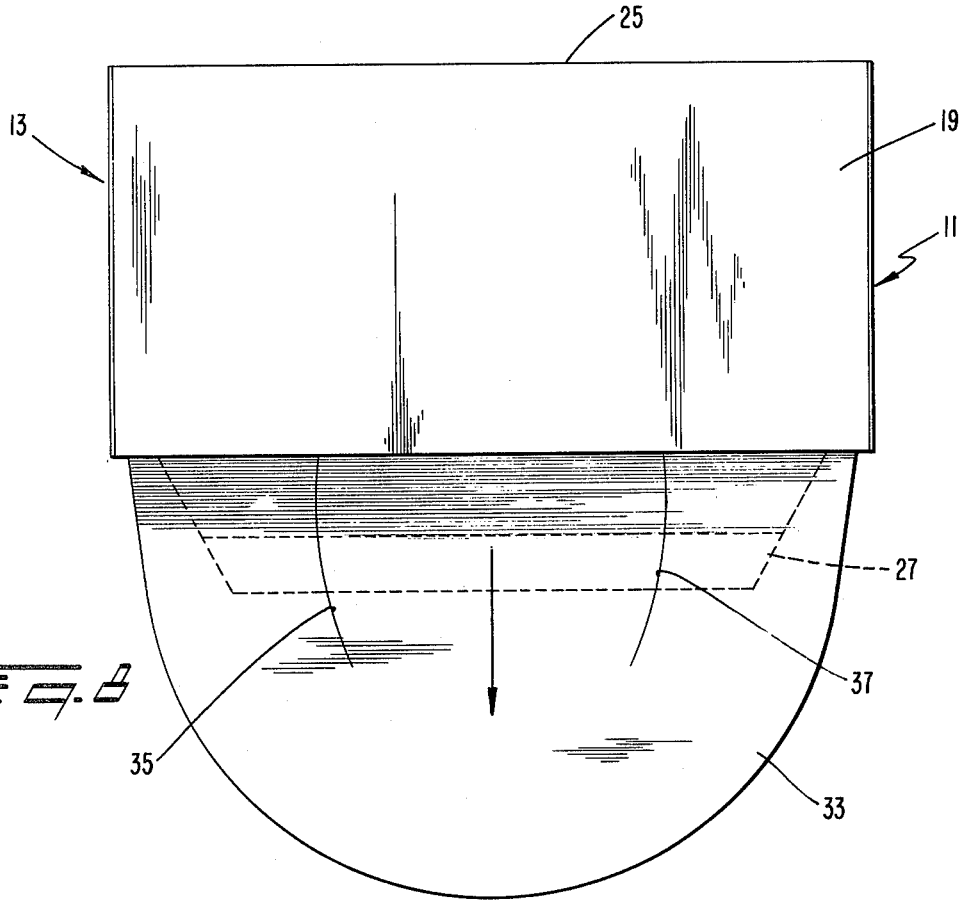
FIG. 8

PAPER SHEET CARTRIDGE

BACKGROUND OF THE INVENTION

This invention relates to paper sheet cartridges from which shaped paper sheets are dispensed one at a time and positioned on a toilet seat.

It is known to provide shaped paper sheets which can be dispensed one at a time and positioned on a toilet seat. For example, in applicant's copending application Ser. No. 886,600, filed Mar. 14, 1978, there is disclosed a construction whereby a stack of shaped paper sheets are hung upon a pair of hooks in a dispensing device positioned adjacent the toilet seat. The dispensing device is manually operated and, through a frictional roller, pulls one of the sheets off the hooks and delivers it atop the toilet seat. The stack of sheets is hung full length in the dispenser and, when the supply is exhausted, the dispenser is opened and a new stack of shaped paper sheets is hung in place on the hooks.

Because of the fact that the sheets are hung full length, the size of the dispenser is large and relatively cumbersome. Further, the hooks support the sheets at a portion of the sheet which is ultimately positioned on the toilet seat. When the sheets are torn from the hooks, tears are formed and this portion of the sheet which renders them objectionable for their intended use.

SUMMARY OF THE INVENTION

The present invention overcomes the above-described drawbacks and provides an improved paper sheet cartridge which includes a container enclosing a stack of shaped paper sheets folded along a transverse line. The paper sheets are shaped to fit a toilet seat and include a central portion which, when the sheet is positioned on the toilet seat, extends downwardly into the bowl and serves to carry the sheet off when the toilet is flushed. The sheets are supported within the container by support means which extend through the sheets at the portion of the sheets which hangs into the bowl during use.

Since the sheets are folded, the size of the container, and therefore the cartridge, is substantially reduced. Further, by supporting the sheets at the portion which, in use, hangs downwardly into the bowl, any tears formed in the sheets during removal of them from the container have no adverse effect on their intended use.

Accordingly, it is the primary object of this invention to provide a new and improved paper sheet cartridge from which paper sheets for covering a toilet seat can be dispensed one-at-a-time.

It is a further object of this invention to provide an improved paper sheet cartridge for use in a device which dispenses single sheets of paper, wherein the sheets are folded along a transverse line in the cartridge container to reduce the overall size of the cartridge.

It is a still further object of this invention to provide a paper sheet cartridge for use in a device which dispenses shaped paper sheets onto a toilet seat, wherein the sheets are supported in the cartridge container by means extending through a portion of the sheets which does not engage the toilet seat during use, so that any tears formed in the sheets during dispensing do not disturb or affect the comfort or sanitation aspects of the sheets in use.

Additional advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the paper sheet cartridge of this invention is for use in a device which dispenses single sheets of paper for covering toilet seats wherein the sheets have an outer portion adapted to rest on and cover the toilet seat and a central tongue adapted to hang downwardly from the outer portion, and comprises a flat elongated container having top and bottom walls, side walls, and an open end, a partition in the container extending parallel to the top and bottom walls, a stack of the paper sheets in the container having one end extending through the open end and outwardly of the container, the paper sheets being folded inside the container and having their other end positioned behind the partition, and means carried by the container penetrating the paper sheets at the central tongue and holding the paper sheets in the container, the penetrating means allowing the innermost of the folded sheets to be withdrawn from the container by applying an outward pulling force on the one end of the innermost folded sheet, whereby the innermost folded sheet tears away from the penetrating means and emerges from the container.

Broadly, the paper sheet cartridge of the present invention comprises a rectangular container having top and bottom walls, a pair of side walls, and an end wall at one end, an opening formed at the other end of the container, a partition in the container spaced from the top and bottom walls and from the end wall, a stack of paper sheets folded along a transverse fold line and in the container, the sheets having one end extending outwardly through the opening, the other end of the sheets being positioned behind the partition, and the transverse fold line being adjacent the end wall, means in the container between the partition and the end wall and aligned with the opening and penetrating the stack of paper sheets adjacent the transverse fold line, the sheets being withdrawable one at a time from the container by pulling on the innermost folded sheet at the one end of the stack of sheets, whereby the innermost sheet tears away from the penetrating means and then gradually unfolds by sliding over the partition.

The accompanying drawings, which are incorporated in and constitute a part of this specification, illustrate one embodiment of the invention and, together with the description, serve to explain the principles of the invention.

BRIEF DESCRIPTION OF THE DRAWINGS

FIG. 7 is a sectional view of FIG. 3 to a reduced scale taken along the line 7—7 thereof; and FIG. 8 is a plan view of FIG. 4 taken along the line 8—8 but with parts removed for clarity.

DETAILED DESCRIPTION

Reference will now be made in detail to the present preferred embodiment of the invention, an example of which is illustrated in the accompanying drawings.

Figure 2:
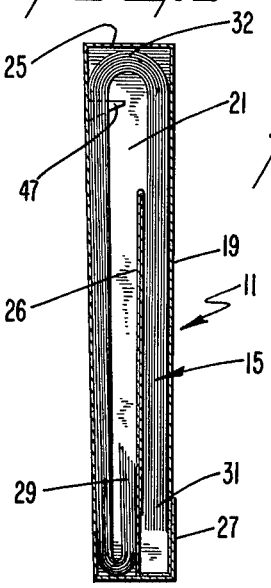
FIG. 2 is a sectional view showing the paper sheet cartridge of the present invention removed from the dispenser and folded in a storage position.
Figure 3:
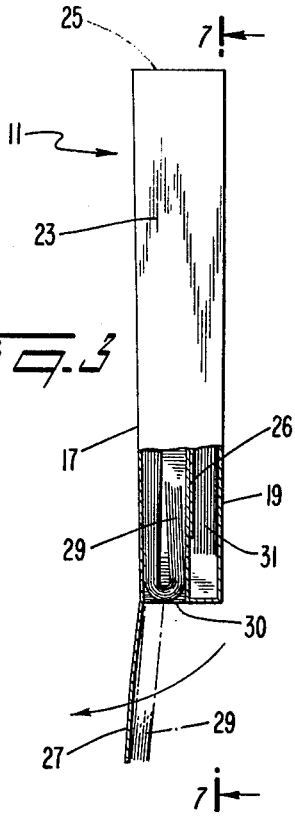
FIG. 3 is a view similar to FIG. 2 and showing the cartridge container opened and, in dot-dash lines, the sheet ends ready for positioning in a dispenser.

The preferred embodiment of the paper sheet cartridge of the invention is shown in FIGS. 2 and 3 and is represented generally by the numeral 11. This cartridge includes a flat container 13 having a stack 15 of paper sheets therein. As embodied herein, the container 13 is flat, elongated and generally rectangular, and has top and bottom walls 17, 19, and side walls 21, 23. One end of the container is closed by an end wall 25. The other end of the container 13 is closed by an extension 27 of top wall 17 which is folded over bottom wall 19 and joined thereto by an adhesive during packaging of the cartridge (see FIG. 2). In this position, one end 29 of the stack 15 of paper sheets is folded into the container 13. To ready the cartridge for dispensing the paper sheets, the extension 27 is opened and straightened, forming an open end 30 in the container 13, and the end 29 of the sheet stack 15 is unfolded to extend through this open end 30 (see FIGS. 3 and 7). A partition 26 extends inwardly from said container open end 30 and parallel to said top and bottom walls 17, 19 and terminates short of end wall 25.

As described above and in accordance with the invention, a stack 15 of paper sheets is disposed in the container 13. As embodied herein, the stack of sheets is folded transversely of its length along a transverse fold line 32 and has one end 29 adapted to extend outwardly of the container 13 through its open end 30. The stack 15 is folded over the partition 26 and the other end 31 of the sheet stack is positioned behind the partition 26. Since the sheet stack 15 curves smoothly at the position adjacent end wall 25, the fold line 32 does not result in a sharp crease and the sheets 33 lay flat when withdrawn from container 13.

Figure 5:
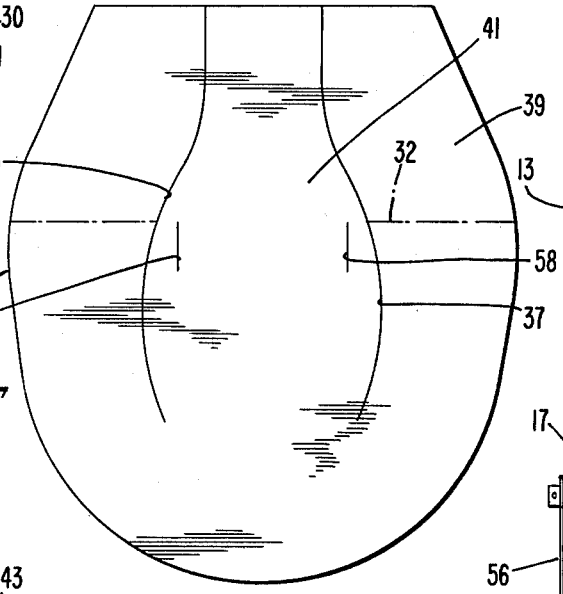
FIG. 5 is a plan view showing a shaped paper sheet used in the cartridge of this invention.
Figure 6:
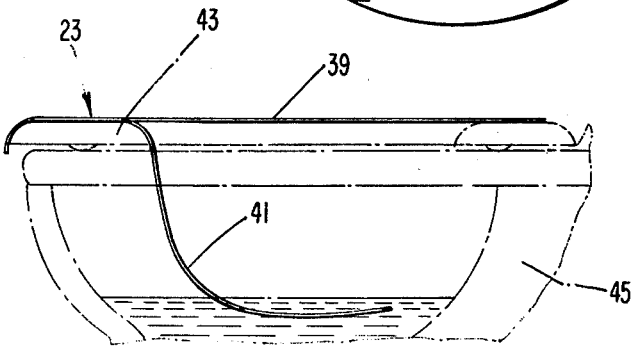
FIG. 6 is a view of a toilet seat and bowl showing a shaped paper sheet in position on the seat and with a central portion of the sheet hanging downwardly into the bowl.

The paper sheets in the stack 15 are shaped identically to one another. One such sheet is illustrated at 33 in FIG. 5 and is seen to have a pair of longitudinally extending slits 35, 37 forming a curved outer portion 39 and a central tongue 41. The outer portion 39 of sheet 33 is shaped generally complementary to but slightly larger than a toilet seat. When the sheet 33 is placed on a toilet seat, such as the showing of sheet 33 on a toilet seat 43 in FIG. 6, the sheet portion 39 covers the seat 43 and the tongue 41 hangs downwardly into a toilet bowl 45. When the toilet is flushed after use, the flowing water pulls on the tongue 41 and carries the sheet 33 away.

Figure 1:
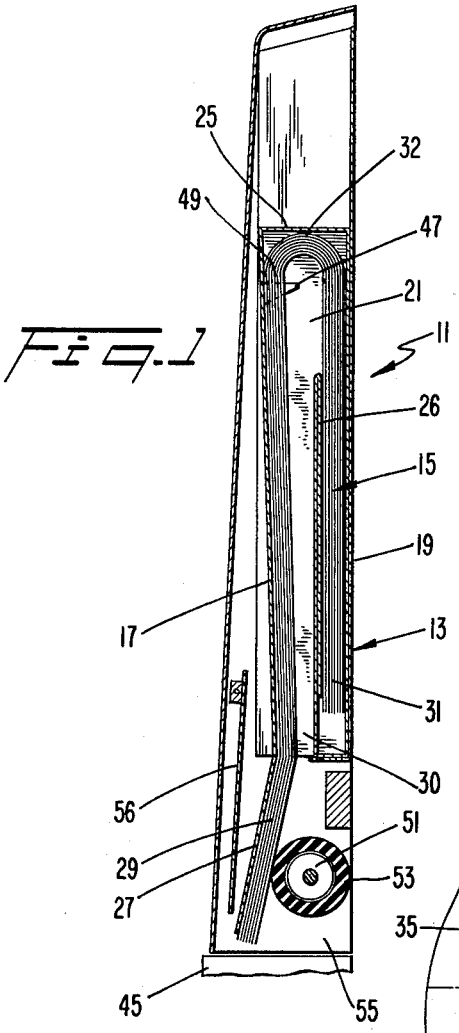
FIG. 1 is a sectional view showing a paper sheet cartridge constructed according to the present invention and positioned in a paper sheet dispensing means.

In accordance with the invention, means carried by the cartridge container penetrates the folded sheets and holds them in place in the container. As embodied herein, the container 13 is provided with a pair of stakes 47, 47 (FIGS. 1, 2 and 7) extending inwardly of top wall 17. When the stack 15 of paper sheets 33 is folded and placed in the container 13 as shown in FIG. 1, the stakes 47, 47 penetrate the sheets 33 in the area of tongue 41. Because the tongue 41 is attached to the outer sheet portion 39, the stakes 47, 47 hold the sheets 33 in place in the container 13.

In accordance with the invention, the penetrating means 47 allows the folded sheets to be withdrawn from the container, one-at-a-time, starting with the innermost one of the folded sheets. As embodied herein, the stakes 47, 47 are provided with a knife edge 49 and are located near the end wall 27 and extend through one fold only of the sheets 33.

When it is desired to remove a sheet 33 from the container 13, a force is exerted on the end of the innermost sheet 33 in the stack 15 which extends through the container open end 30 tending to pull that sheet out of the container 13. This is done, for example, by means of a rotatable roller 51 having an outer frictional surface 53 and journaled on a frame 55 supported on or adjacent the toilet bowl 45. A pressure plate 56 may be provided to engage the container extension 27 and bias the end 29 of the sheet stack 29 toward the roller 51 (see FIGS. 1 and 4).

Figure 4:
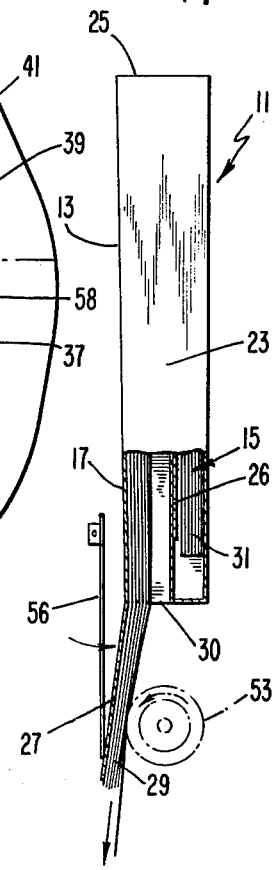
FIG. 4 is a view similar to FIG. 1 and showing, schematically, a single paper sheet being dispensed from the cartridge container.

When the roller 51 is turned in a counterclockwise direction, as seen in FIG. 4, it pulls the innermost sheet 33 from the stack 15 and withdraws it from the container 13. As this occurs, the knife edges 49 on stakes 47 slice through the portion of the sheet 33 up to the transverse fold line 32 in the sheet. After that, the sheet 33 continues to emerge from the container 13 with continued roller feed by unfolding and sliding around the partition 26. The other sheets 33 of the stack 15 remain in place in the container 13 by virtue of the stakes 47, 47 and the partition 26. A sheet 33 emerging from the container 13 is shown in FIG. 8.

As described above, the outer portion 39 of the sheet 33 is shaped to cover the toilet seat 43 while the tongue 41 extends downwardly into the bowl 45. The stakes 47, 47 are positioned to penetrate the tongue 41, and when the sheet 33 is withdrawn and delivered from the container 13, the stakes 47, 47 make two slits in the tongue 41 as is shown at 57, 58 in FIG. 5. Since the only function of the tongue 41 is to carry the sheet 33 away after use, these slits have no effect whatsoever on the comfort or sanitation aspects of the sheet 33.

Also, since the sheets 33 are folded in the container 13, the overall size of that container is considerably reduced. This is particularly advantageous in the use of this invention in a dispenser for paper sheets used to cover toilet seats where the dispenser is mounted on or adjacent the toilet.

While a preferred embodiment of this invention has been illustrated and described in detail, various additions, substitutions, modifications, and omissions may be made thereto without departing from the spirit of the invention.

What is claimed is:

1. A paper sheet cartridge for use in a device which dispenses single sheets of paper for use in covering toilet seats, said sheets having an outer portion adapted to rest on and cover said toilet seat and a central tongue adapted to hang downwardly from said outer portion, said cartridge comprising a flat, elongated container having top and bottom walls, side walls, and an open end, a partition in said container extending parallel to said top and bottom walls, a stack of said paper sheets in said container having one end extending through said open end and outwardly of said container, said paper sheets being folded inside said container and having their other end positioned behind said partition, and means carried by said container penetrating said paper sheets at said central tongue and holding said paper sheets in said container, said penetrating means allowing the innermost of said folded sheets to be withdrawn from said container by applying an outward pulling force on said one end of said innermost folded sheet, whereby said innermost folded sheet tears away from said penetrating means and emerges from said container.

2. A cartridge as defined in claim 1, said container top wall having an extension adapted to fold over and join to said bottom wall thereby closing said open end, said one end of said stack of paper sheets being foldable into said container.

3. A cartridge as defined in claim 1, said container having a closed end opposite said open end, said partition being spaced from said closed end, said penetrating means positioned between said partition and said closed end.

4. A cartridge as defined in claim 1, said penetrating means including a pair of stakes having knife edges facing away from said open end.

5. A paper sheet cartridge comprising a rectangular container having top and bottom walls, a pair of side walls, and an end wall at one end, an opening formed at the other end of said container, a partition in said container spaced from said top and bottom walls and from said end wall, a stack of paper sheets folded along a transverse fold line and in said container, said sheets having one end extending outwardly through said opening, the other end of said sheets being positioned behind said partition and said transverse fold line being adjacent said end wall, means in said container between said partition and said end wall and aligned with said opening and penetrating said stack of paper sheets adjacent said transverse fold line, said sheets being withdrawable one-at-a time from said container by pulling on the innermost folded sheet at said one end of the stack of sheets, whereby said innermost sheet tears away from said penetrating means and then gradually unfolds by sliding over said partition.

* * * * *